US005098111A

United States Patent [19]

Kashimoto

[11] Patent Number: 5,098,111

[45] Date of Patent: Mar. 24, 1992

[54] ORNAMENTAL GAME WITH UNDERWATER MOVING MECHANISM

[75] Inventor: Kiyoshi Kashimoto, Tokyo, Japan

[73] Assignee: Tomy Company, Ltd., Tokyo, Japan

[21] Appl. No.: 675,806

[22] Filed: Mar. 27, 1991

[30] Foreign Application Priority Data

Dec. 6, 1990 [JP] Japan ..... 2-62044

[51] Int. Cl.[5] ..... A63F 9/00

[52] U.S. Cl. ..... 273/457; 40/406; 446/197

[58] Field of Search ..... 273/457; 446/197; 40/406

[56] References Cited

U.S. PATENT DOCUMENTS 3,057,094 10/1962 Winkelman ..... 40/406
4,142,715 3/1979 Matsumoto ..... 273/457
4,160,427 7/1979 Holbrook ..... 40/406
4,923,429 5/1990 Lewis ..... 273/457 X

FOREIGN PATENT DOCUMENTS 2913469 10/1980 Fed. Rep. of Germany ..... 273/457

*Primary Examiner*—Paul E. Shapiro
*Attorney, Agent, or Firm*—Staas & Halsey

[57] ABSTRACT

An ornamental game includes a transparent tank preferably having three sides. A fluid contained in and substantially filling the transparent tank is circulated in a direction rearward to forward by means of a rising fluid path. A plurality of movable members, each having a specific gravity slightly greater than that of the fluid are propelled upwardly in the rising fluid path by the rising current of fluid and are discharged from the open top of the partition plate, and a target mounted on an ornamental body disposed in front of the partition plate below the top thereof in the circulatory flow path of fluid catches the movable members on the target.

8 Claims, 5 Drawing Sheets

ORNAMENTAL GAME WITH UNDERWATER MOVING MECHANISM

BACKGROUND OF THE INVENTION

1. Field of the Invention

The present invention relates generally to amusement devices and, more specifically, to an ornamental game with an underwater moving mechanism wherein liquid and movable members formed from a material having a specific gravity slightly greater than the liquid are enclosed in a water tank in which an ornamental body formed in a desired configuration is disposed and a circulating liquid flow is produced in the water tank by a pump mechanism so that the movable members move downwardly from above the ornamental body.

2. Description of the Related Art

A game in which movable members are enclosed in a water tank and are moved by a pump to play the game is described in Japanese Utility Model Publication No. 312/1979. The underwater moving game disclosed therein includes a depressible member (button) which is depressed by finger tip manipulation by a player to cause a pressure generating member (pump) connected to an end portion of a pipe to be contracted to feed liquid inside the pipe into the water tank from a bottom portion of the water tank under pressure to produce a flow of the liquid in the water tank, thereby moving the movable members in the water tank so that the movable members are caught by a target disposed in the water tank.

In the underwater moving game disclosed in Japanese Utility Model Publication No. 312/1979, the water tank itself is formed in a flattened shape, and the dimension of depth of the water tank is so small that a solid body cannot be disposed in the water tank. In addition, a water flow generated in the water tank circulates in a circular flow pattern in a longitudinal direction of the width of the water tank. Thus, the water tank is constituted such that all of the rising movements and falling movements of the movable members can be seen. While this is not a problem as a moving mechanism of a game apparatus, when it is used as an ornamental game for visual appreciation and has an object to create a visual interesting feeling, there is the possibility that the visual impression may be lessened.

SUMMARY OF THE INVENTION

The present invention has been made in view of the problem described above, and it is an object of the present invention to provide an ornamental game with an underwater moving mechanism wherein moving members are discharged radially in a direction toward a front plate of a water tank from an upper end of a rear portion in the water tank in which a solid ornament body is disposed so that the moving members can be moved downwardly in such a condition as they appear to be falling from above the ornament body.

This and other objects of the present invention are met by providing an ornamental game with an underwater moving mechanism including a water tank having a horizontal section of a substantially triangular shape and having an outer shell formed from a transparent material, and a base having a pump mechanism built therein, one side face of the water tank being formed as a front plate provided uprightly in a direction toward the front of the base, a partition plate having open upper and lower ends provided fixedly at a corner opposite the front plate in the water tank to form a rising water path for liquid, an ornamental body formed in a desired configuration disposed in the water tank, a plurality of movable members disposed in the water tank and being made of a material having a specific gravity slightly greater than that of the liquid filled in the water tank, and a liquid nozzle formed at a bottom portion of the water tank adjacent the lower end of the rising water path, the liquid nozzle being connected to the pump mechanism by way of a pipe, and the pump mechanism being operative in response to a depressing operation of a button provided projectingly on the base.

With the ornamental game described above, if the button provided projectingly on the base is operated to be depressed, then the pump mechanism is rendered operative so that the liquid is jetted from the liquid nozzle provided at the bottom portion of the water tank toward the rising water path provided at the corner portion of the water tank, and the movable members are carried by the liquid flow and raised in the rising water path and then discharged into the water tank from the opening at the upper end of the rising water path, whereafter the movable members move down slowly.

In the following, an embodiment of an ornamental game with an underwater moving mechanism according to the present invention will be described with reference to the drawings.

DETAILED DESCRIPTION OF THE PREFERRED EMBODIMENT

Figure 1:
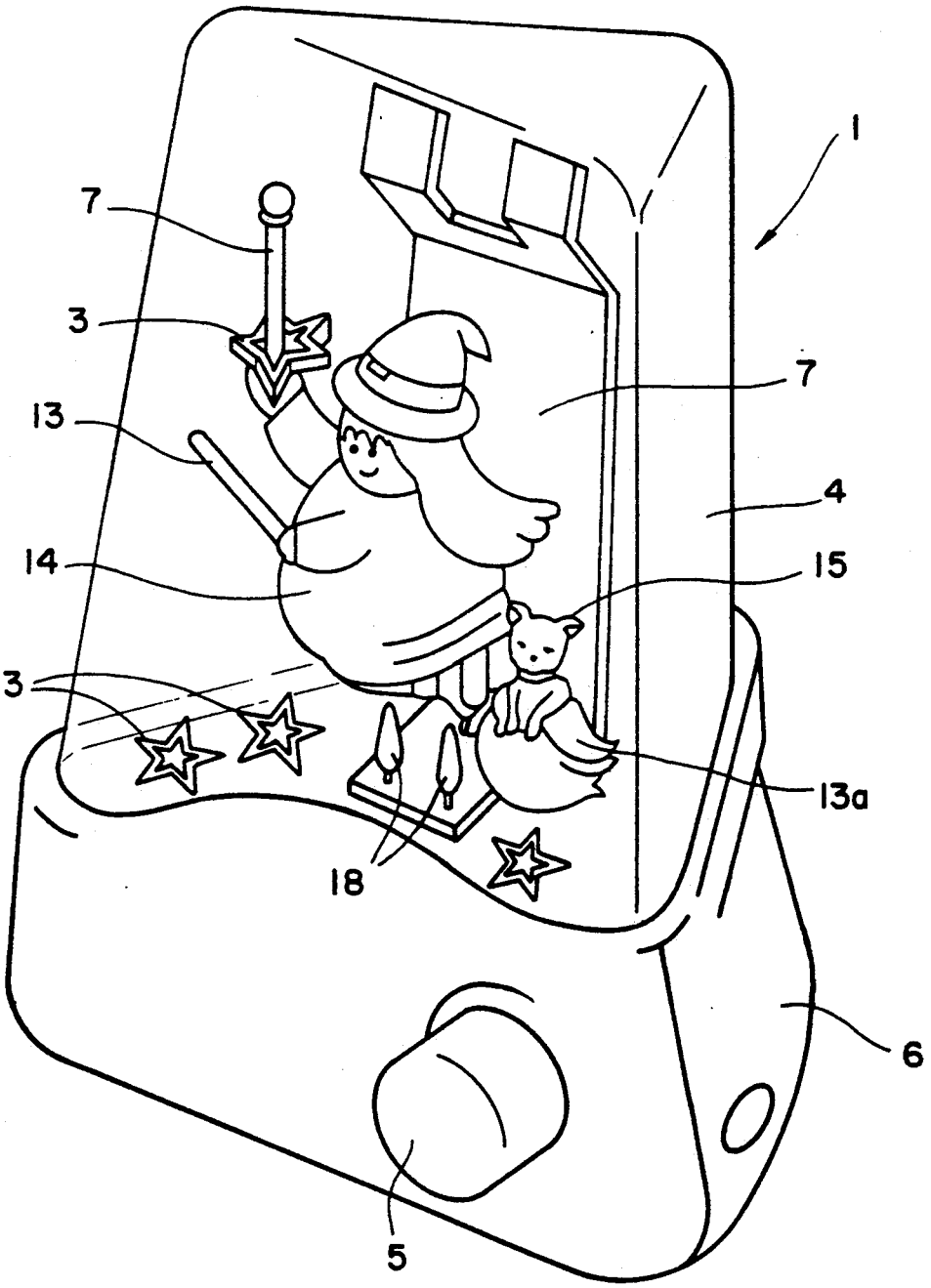
FIG. 1 is a perspective view of an ornamental game according to the present invention.

A perspective view of the ornamental game of the preferred embodiment is shown in FIG. 1.

An ornamental game 1 of a preferred embodiment includes a water tank 4 which is substantially filled with a liquid 2 (FIG. 2), and encloses an ornamental body and a plurality of movable members 3. A base 6 houses a pump mechanism 11 (FIG. 2) which is rendered operative in response to a depressing operation of a button 5 projecting outwardly from the front of the base 6 to produce a flow (rising flow) in a rising water path 8 (FIG. 2) formed at a corner portion of the water tank 4 to form a circulating liquid flow in the water tank 4 so that the movable members 3 in the water tank 4 may be moved. In the illustrated embodiment the pump draws in air which is released under pressure from nozzle 12*a* to "jet" the water upwardly. The pump could be modified to simply draw in water from the tank and eject it from the nozzle under pressure to generate the same effect. Thus, the flow may result from the introduction of pressurized liquid, pressurized air (air bubbles), or both, so long as a current is generated capable of lifting the movable member 3 in the rising water path 8.

Figure 2:
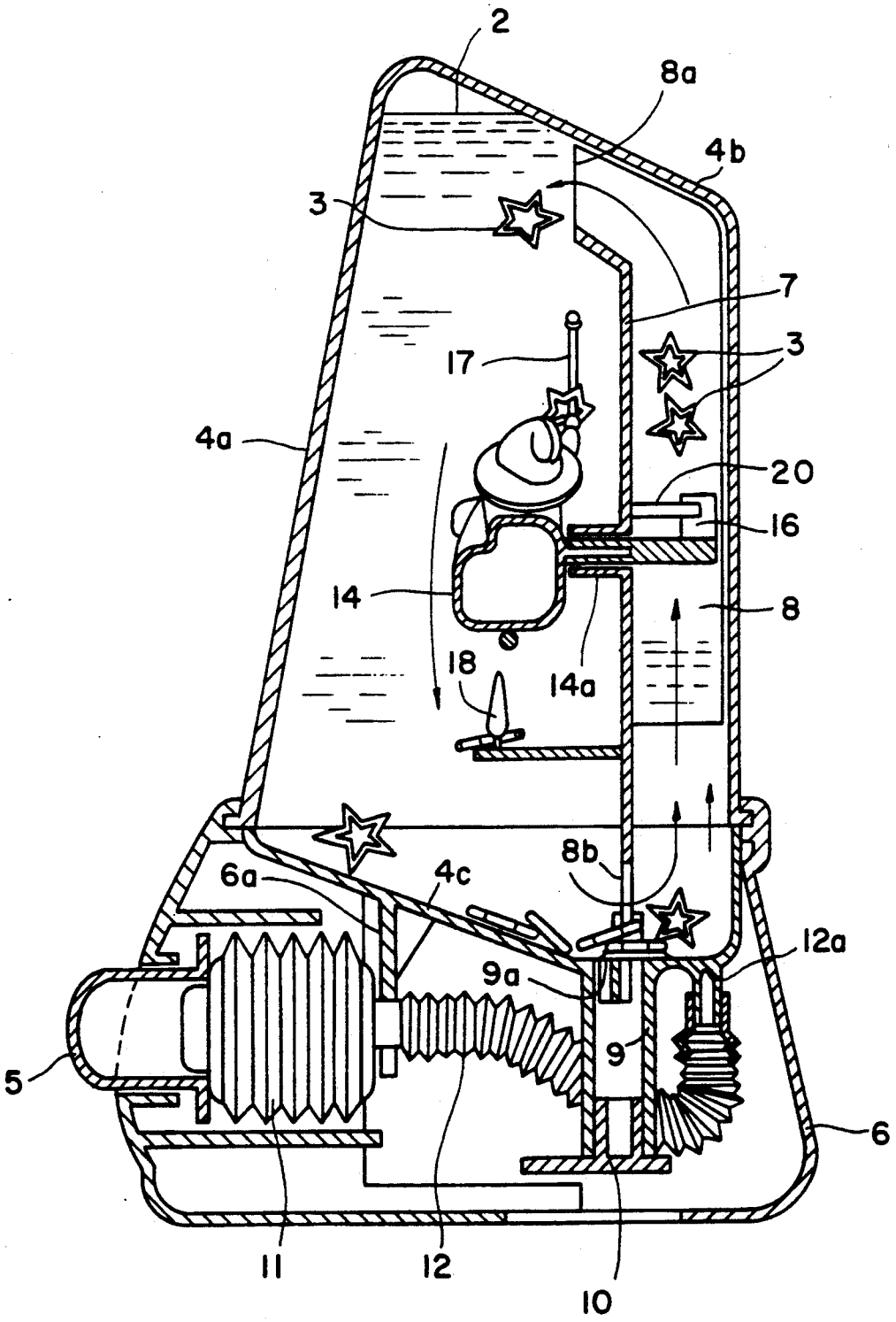
FIG. 2 is a vertical sectional view of the ornamental game of FIG. 1.

The water tank 4 is constituted such that an outer shell thereof is formed of a transparent member, for example, transparent glass or plastic and a horizontal section thereof presents a substantially triangular shape. A side wall thereof is provided uprightly as a front plate 4a directed toward the front of the base 6. An upper wall 4b of the water tank 4 is formed as an inclined surface that it has an ascending slope toward the front as shown in FIG. 2. Meanwhile, as shown in FIG. 2, a bottom wall 4c of the water tank 4 is similarly formed as an inclined face that has an ascending slope toward the front, thus giving a vertical, longitudinal sectional shape in the form of a rhomboid. Accordingly, when the movable members 3 enclosed in the inside of the water tank 4 and having a specific gravity slightly greater than the liquid 2 fall to the bottom wall 4c of the water tank 4, the movable members 3 will slide toward the rear along the bottom wall 4c by their own weight. Even if the movable members do not slide by their own weight completely to the rear, the circulatory flow path fluid will propel the movable members 3 towards the rear and into the rising path 8.

Near a corner opposite to the front plate 4a of the water tank 4, in the interior of the water tank 4, a partition plate 7 having open upper and lower ends extends transversely and substantially parallel to the front plate 4a. The rising water path 8 having openings 8a and 8b at the upper and lower ends thereof, respectively, is disposed at the corner as shown in FIG. 2 and is defined by the partition plate 7 and the converging sides of the tank 4.

Figure 3:
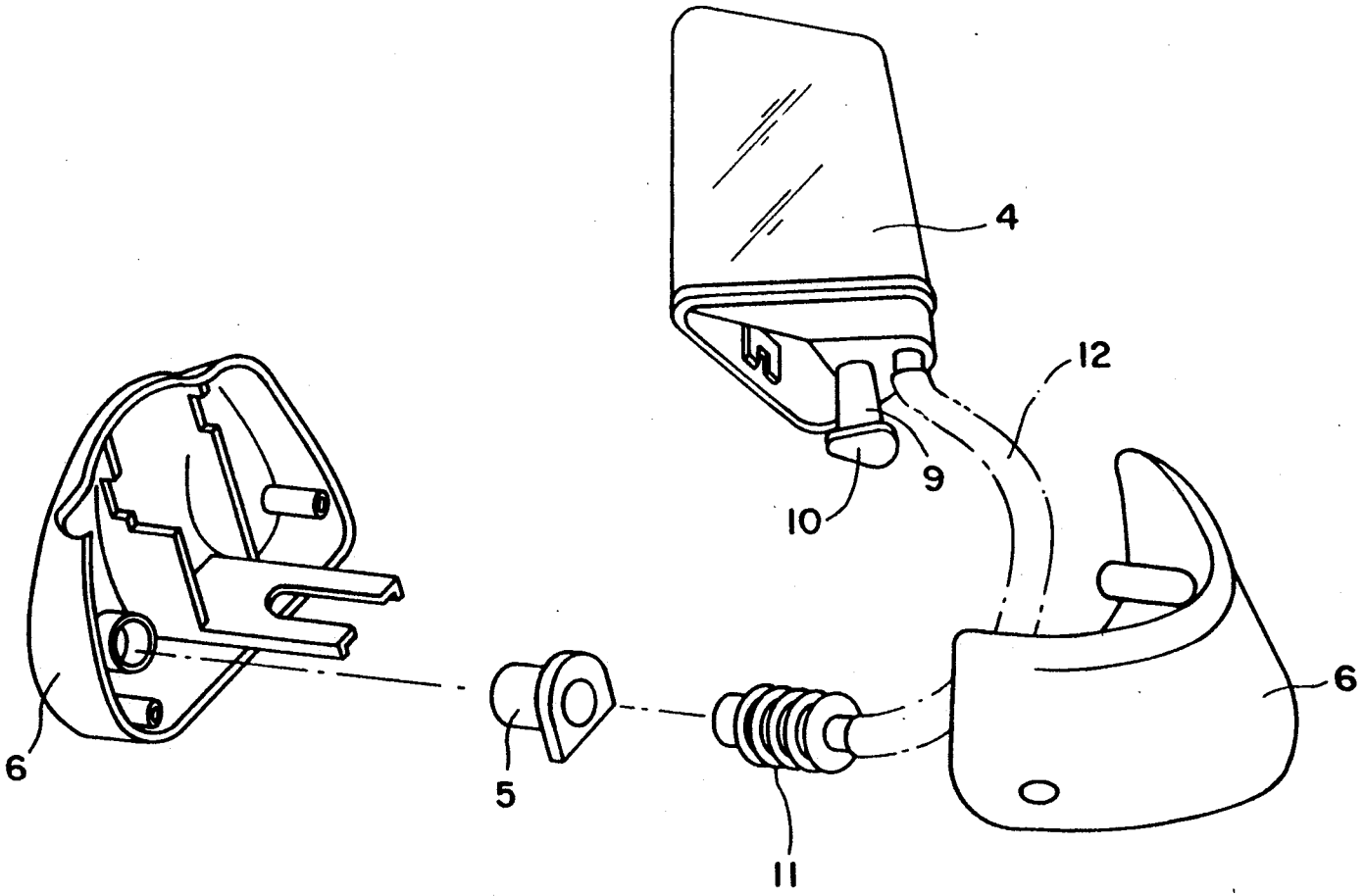
FIG. 3 is a fragmentary perspective view of the ornamental game of FIG. 1.

Further, a liquid supplementing pipe 9 is disposed at the bottom portion of the water tank 4 as shown in FIGS. 2 and 3 and allows for liquid filling in accordance with necessity. A liquid supplementing hole 9a which is an upper end opening of the liquid supplementing pipe 9 is disposed in the vicinity of a liquid nozzle 12a which will be hereinafter described. A removable cap 10 is snap-fitted or otherwise sealingly disposed on a lower end opening of the liquid supplementing pipe 9 as shown in FIGS. 2 and 3 to permit filling and/or draining as needed.

The liquid nozzle 12a is disposed in the bottom portion of the water tank 4 adjacent a lower end of the rising water path 8 and is connected to the pump mechanism 11 by way of a corrugated flexible pipe 12, although other suitable conduits may be employed. The pump mechanism 11 has the form of a bellows and is flexible so that it can be expanded and contracted similarly to the pipe 12. The pump mechanism 11 is rendered operative in response to a depressing operation of the button 5 projecting outwardly from the base 6. More particularly, the pump mechanism 11 is held between the button 5 and a fixed wall 6a inside the base 6. The pump mechanism 11 is contracted in response to a depressing operation of the button 5. By such operation of the pump mechanism 11, part of the liquid 2 in the pipe 12 is fed into the water tank 4 through the liquid nozzle 12a and forms a rising flow in the water tank 4, more particularly in the rising water path 8.

Figure 4:
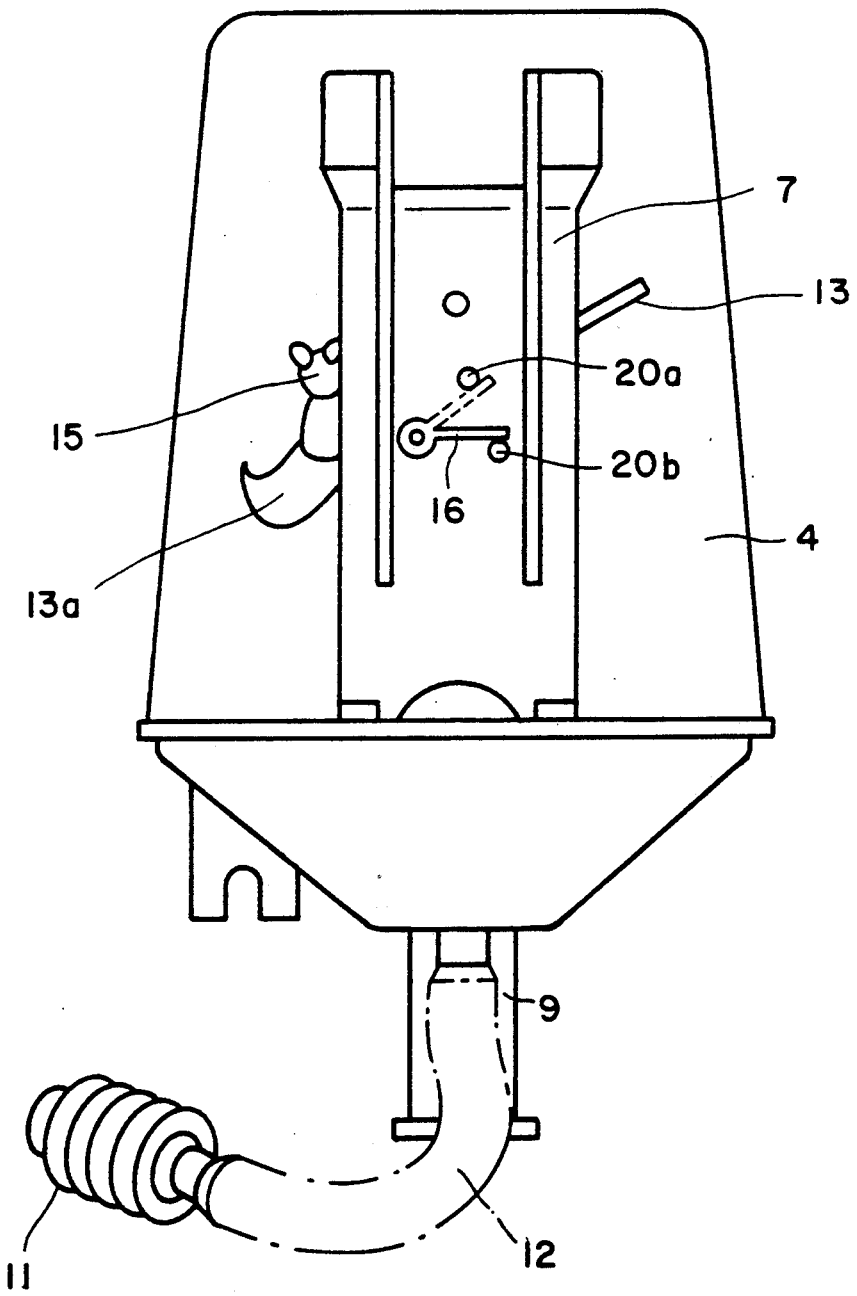
FIG. 4 is a rear elevational view showing a water tank and a pipe of the ornamental game of FIG. 1.

An ornamental doll body 14 in the form of a doll which in the illustrated embodiment resembles a witch flying through the sky on a broom 13 is disposed in front of the partition plate 7 in the water tank 4. A cat 15 sits on a bristle bundle 13a at a rear end of the broom 13. The ornamental body 14 is mounted for pivotal motion about a shaft 14a (FIG. 2) journalled in the partition plate 7. Meanwhile, a weir 16 is provided at an end of the shaft 14a which extends through the partition plate 7 into the rising water path 8 as shown in FIGS. 2 and 4. Accordingly, when a rising flow of the liquid 2 (or succession of air bubbles) is formed in the rising water path 8, the weir 16 is oscillated together with the shaft 14a so that the ornamental body 14 is caused to undergo a rocking motion by such oscillation of the shaft 14a.

It is to be noted that reference numerals 20a and 20b in FIGS. 2 and 4 denote stopper pins for restricting the rotational angle of the weir 16 and hence the range of rocking movement of the body 14.

A stick 17 resembling a magic wand provides a target for the movable members 3 and extends upwardly from the right hand of the ornamental body 14. The movable members 3, each in the shape of a star with a hole in the middle, can be caught on the stick 17. Meanwhile, upstanding projections 18 in the shape of trees provide other targets for the movable members 3 below the ornamental body 14.

In the ornament 1 having the construction such as described above, the ornamental body 14, broom 1, stick 17 and trees 18 all contribute to the ornamental and aesthetic effect.

Figure 5:
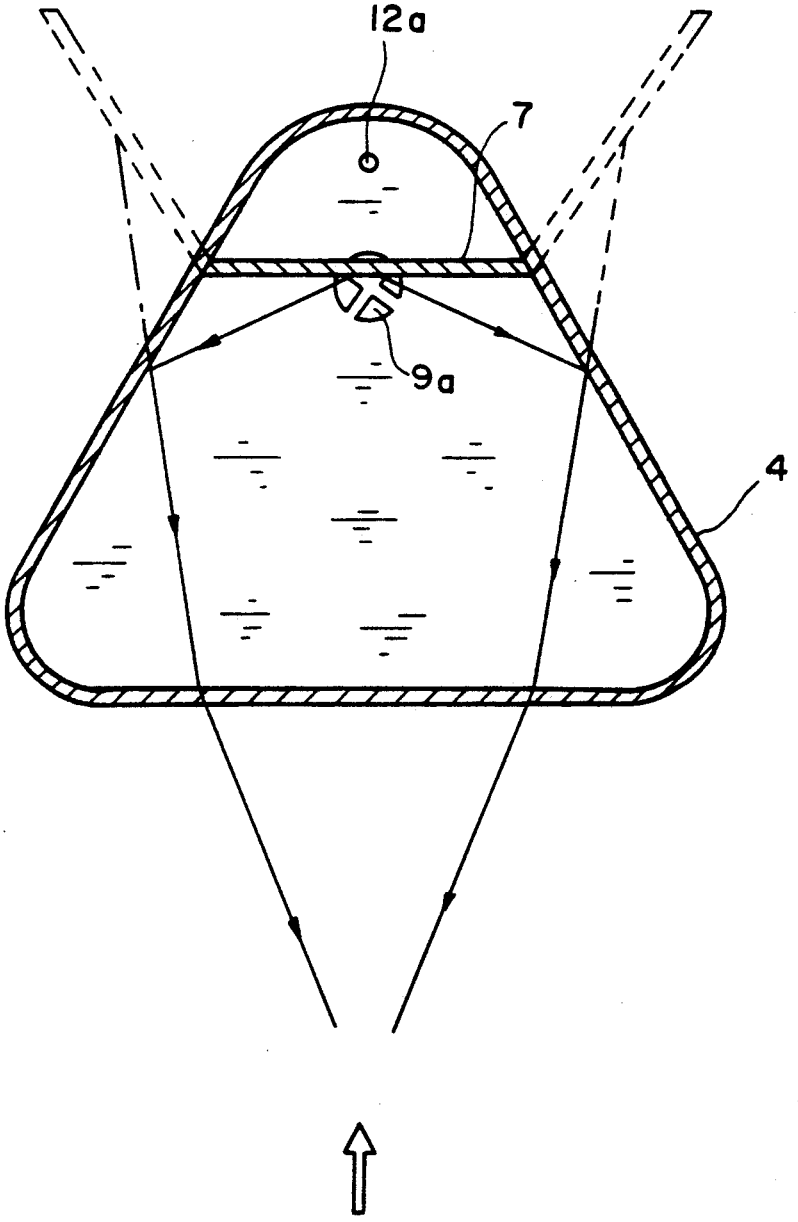
FIG. 5 is a horizontal sectional view of the water tank for explaining a mirror effect of the water tank.

It is to be noted that, in the ornamental game 1 of the embodiment described above, the characteristic of the transparent material, the liquid (preferably water), the arrangement of the ornamental body 14 and so forth are determined such that, when the body 14 is observed from the front, the body 14 can be viewed from three different angles; in short, the two side faces of the body 14 except the front face create a mirror effect as shown in FIG. 5.

Operation of the ornament 1 having such construction as described above will now be described. In a static condition, the movable members 3 having a specific gravity slightly greater than the liquid 2 gravitate to the bottom portion of the water tank 4.

In response to a depressing operation of the button 5, the pump mechanism 11 is rendered operative so that a rising flow of the liquid 2 is formed in the rising water path 8 by partial spouting of the liquid 2 from the pipe 12. Riding on the rising flow, the movable members 3 (each resembling a star) are raised in the rising water path 8 and discharged radially in a direction toward the front plate of the water tank 4 from the upper end opening portion 8a of the partition plate 7. Then, the movable members 3 are moved down slowly in the liquid 2, but the movable members 3 which reach an end of the stick 17 are fitted on and caught by the stick 17. The player is thus able to create the impression that the ornamental body 14 (witch) is collecting stars with the stick 17.

It is to be noted that such catching of the movable members 3 is also performed by the trees 18 which are the other targets positioned below the body 14. In order to release the movable members 3 once caught by the targets, the ornamental game 1 can be inverted by the player.

With the ornamental game 1 of the embodiment having such construction as described above, the following effects can be obtained. In particular, with the ornamental game 1 of the embodiment described above, since the water tank 4 is constituted such that the horizontal section thereof presents a substantially triangular shape, the depth of the water tank 4 becomes comparatively great. Accordingly, it is possible to dispose various types of solid ornamental bodies inside the water tank 4 and also to dispose the targets in a three dimensional relationship.

Further, a liquid flow can be generated circulating in a circular condition in a direction perpendicular to the front plate of the ornament 1. Therefor, since rise of the liquid flow is performed in the rising water path 8 which cannot be visually observed from the front side, the movable members 3 moving on the liquid flow cannot be observed upon such rising movement. On the other hand, downward movement of the movable members 3 can be visually observed from the front. Accordingly, if the movable members 3 which resemble such articles that will normally drop from above to below are used as the movable members 3, then a further visual feeling will be obtained.

By using the ornamental game 1 of the embodiment described above, since the water tank 4 itself is provided with a mirror effect, when the inside of the water tank 4 is observed, for example, from the front, the water tank 4 looks larger than its actual size. Further, an ornamental body (here, the body 14) disposed in the inside of the ornament 1 can be seen from a number of different angles, an the aesthetic effect is thus improved.

While the present invention has been described in detail so far in connection with a preferred embodiment, the invention is not limited to the embodiment described above and can naturally be altered variously within the scope of the invention. For example, while the nozzle 12*a* is located adjacent the lower end of the rising water path 8 in the embodiment described above, it may also be located just below the partition plate 7 to cause part of the liquid 2 pumped out of the pipe 12 by the pump mechanism 11 to be jetted by a small amount to the front of the partition plate 7.

Further, while the body resembling a witch is disposed as the principal ornamental body, virtually any other object, animate or inanimate, may be employed as the principal ornamental body if it has an aesthetic effect (for example, a model of a house including a model of a street, a flower, a Christmas tree, etc.)

While the movable members 3 are shown to be of a star shape in the embodiment described above, small pieces of aluminum foil resembling snow or paper snowfall, small pieces of a resin resembling a heart mark, etc. may be employed.

As apparent from the foregoing description, according to the present invention, an ornamental game with an underwater moving mechanism is constituted such that it includes a water tank, or other fluid holding tank, having a horizontal section of a substantially triangular shape and having an outer shell formed from a transparent material, and a base having a pump mechanism built therein, that one side face of the water tank is formed as a front plate provided uprightly in a direction toward the front of the base, that a partition plate having upper and lower ends opened is provided fixedly at a corner opposite to the front plate in the water tank to form a rising water path for liquid, that an ornament body formed in a desired configuration is disposed in the water tank while a plurality of movable members formed from a substance having a specific gravity slightly greater than the liquid filled in the water tank are accommodated in the water tank, that a nozzle is formed at a bottom portion of the water tank adjacent the lower end of the rising water path, that the nozzle is connected to the pump mechanism by way of a pipe, and that the pump mechanism is rendered operative in response to a depressing operation of a button provided projectingly on the base. Accordingly, a rigid ornamental body can be disposed therein, and is possible to discharge the movable members radially in a direction toward the front plate of the water tank from the upper end of the rear portion in the water tank to cause the movable members to move down from above the ornamental body in such a condition that the movable members appear to be falling. Consequently, a further visual sensation can be obtained.

What is claimed is:

1. An ornamental game comprising:

a transparent tank having a top, a bottom and at least three side walls, one of the side walls providing a front face;

a fluid contained in and substantially filling the transparent tank and having a specific gravity;

a base for supporting the tank;

a pump disposed in the base;

a partition plate having an open top and bottom and being oriented vertically and disposed in a rear portion of the tank to form a rising fluid path;

an outlet nozzle connected to the pump and being disposed near the bottom of the partition plate to generate a rising current of fluid in the rising fluid path, thus generating a circulatory flow path of fluid which circulates about an axis substantially parallel to the front face of the tank;

a plurality of movable members, each having a specific gravity slightly greater than that of the fluid, each being propelled upwardly in the rising fluid path by the rising current of fluid and being discharged from the open top of the partition plate; and a target mounted on an ornamental body disposed in front of the partition plate below the top thereof in the circulatory flow path of fluid to catch the movable members on the target.

2. An ornamental game according to claim 1, wherein the ornamental body is pivotally mounted in the tank for oscillating movement in response to fluid flow generated by the pump.

3. An ornamental game according to claim 2, wherein the ornamental body includes a pivot shaft journalled in the partition plate and a weir connected to the pivot shaft and extending into the rising fluid flow path to impart oscillatory movement of the ornamental body in response to fluid flow.

4. An ornamental game according to claim 1, wherein the tank is substantially triangular in horizontal cross-sectional shape.

5. An ornamental game according to claim 1, further comprising a plurality of supplemental targets extending upwardly from the bottom of the tank.

6. An ornamental game according to claim 1, wherein the tank has a shape of a rhomboid in vertical cross-section, and wherein the bottom of the tank slopes downwardly from the front face towards the open bottom of the rising fluid flow path.

7. An ornamental game according to claim 1, wherein each of the plurality of movable members is in the shape of a star having an opening and the target includes a stick which catches each movable member through the opening.

8. An ornamental game according to claim 1, further comprising a sealable opening disposed in the bottom of the tank for filling and draining fluid from the tank.

* * * * *